US011135839B2

(12) United States Patent
Cumbie et al.

(10) Patent No.: US 11,135,839 B2
(45) Date of Patent: Oct. 5, 2021

(54) DIE CONTACT FORMATIONS

(71) Applicant: HEWLETT-PACKARD DEVELOPMENT COMPANY, L.P., Spring, TX (US)

(72) Inventors: Michael W Cumbie, Corvallis, OR (US); Anthony Fuller, Corvallis, OR (US); Chien-Hua Chen, Corvallis, OR (US); Zhen Yi Li, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/629,120

(22) PCT Filed: Jul. 26, 2017

(86) PCT No.: PCT/US2017/044027

§ 371 (c)(1),
(2) Date: Jan. 7, 2020

(87) PCT Pub. No.: WO2019/022735

PCT Pub. Date: Jan. 31, 2019

(65) Prior Publication Data

US 2020/0164645 A1 May 28, 2020

(51) Int. Cl.

| | |
|---|---|
| ***B41J 2/14*** | (2006.01) |
| ***B41J 2/16*** | (2006.01) |
| ***B41J 2/045*** | (2006.01) |

(52) U.S. Cl.

CPC ..... *B41J 2/14072* (2013.01); *B41J 2/1637* (2013.01); *B41J 2/04541* (2013.01); *B41J 2/14201* (2013.01); *B41J 2/1623* (2013.01); *B41J 2002/14491* (2013.01)

(58) Field of Classification Search

CPC .... B41J 2/1637; B41J 2202/20; B41J 2/1433; B41J 2/1601; B41J 2/14201; B41J 2002/14491; B41J 2/14072; B41J 2/14; B41J 2/16; B41J 2/04541; B41J 2/1623

See application file for complete search history.

(56) References Cited

U.S. PATENT DOCUMENTS

| | | | |
|---|---|---|---|
| 7,255,428 | B2 | 8/2007 | Hara |
| 8,789,924 | B2 | 7/2014 | Bibl et al. |
| 8,988,093 | B2 | 3/2015 | Rathburn |
| 9,263,361 | B2 | 2/2016 | Pagaila et al. |

(Continued)

FOREIGN PATENT DOCUMENTS

| | | |
|---|---|---|
| CN | 105793044 | 7/2016 |
| JP | 02206558 | 8/1990 |

(Continued)

OTHER PUBLICATIONS

Pascariu, G. et al., Next-generation Electronics Packaging Using Flip Chip Technology.

*Primary Examiner* — Jannelle M Lebron

(74) *Attorney, Agent, or Firm* — Dierker & Kavanaugh PC

(57) ABSTRACT

Examples include a fluid die embedded in a molded panel. The fluid die includes a substrate, and the substrate includes a first surface. The molded panel surrounding sides of the fluid die such that the first surface is disposed below a top surface of the molded panel. A raised contact formation is disposed on the substrate to extend at least up to the top surface of the molded panel.

15 Claims, 6 Drawing Sheets

(56) References Cited

U.S. PATENT DOCUMENTS

| | | | | |
|---|---|---|---|---|
| 9,401,338 | B2 | 7/2016 | Magnus et al. | |
| 2006/0187267 | A1 | 8/2006 | Anderson et al. | |
| 2009/0315947 | A1* | 12/2009 | Atsuta | B41J 2/1603 347/50 |
| 2014/0359984 | A1 | 12/2014 | Kashu et al. | |
| 2015/0041987 | A1 | 2/2015 | Yew et al. | |
| 2016/0001554 | A1* | 1/2016 | Chen | B41J 2/1601 347/50 |
| 2016/0257117 | A1* | 9/2016 | Chen | B41J 2/1433 |
| 2016/0347061 | A1 | 12/2016 | Chen et al. | |

FOREIGN PATENT DOCUMENTS

| | | | |
|---|---|---|---|
| JP | 2007276210 | | 10/2007 |
| JP | 2008120056 | | 5/2008 |
| JP | 2010000704 | | 1/2010 |
| JP | 2014226917 | | 12/2014 |
| JP | 2016508461 | | 3/2016 |
| JP | 2016508906 | | 3/2016 |
| WO | WO2004028811 | A3 | 9/2004 |
| WO | WO-2014133561 | | 9/2014 |
| WO | WO-2015065320 | | 5/2015 |
| WO | WO2015080730 | A1 | 6/2015 |
| WO | WO-2017065728 | A1 | 4/2017 |
| WO | WO-2017078716 | | 5/2017 |

* cited by examiner

DIE CONTACT FORMATIONS

BACKGROUND

Printers are devices that deposit a fluid, such as ink, on a print medium, such as paper. A printer may include a printhead that is connected to a printing material reservoir. The printing material may be expelled, dispensed, and/or ejected from the printhead onto a physical medium.

DRAWINGS

Figure 1:
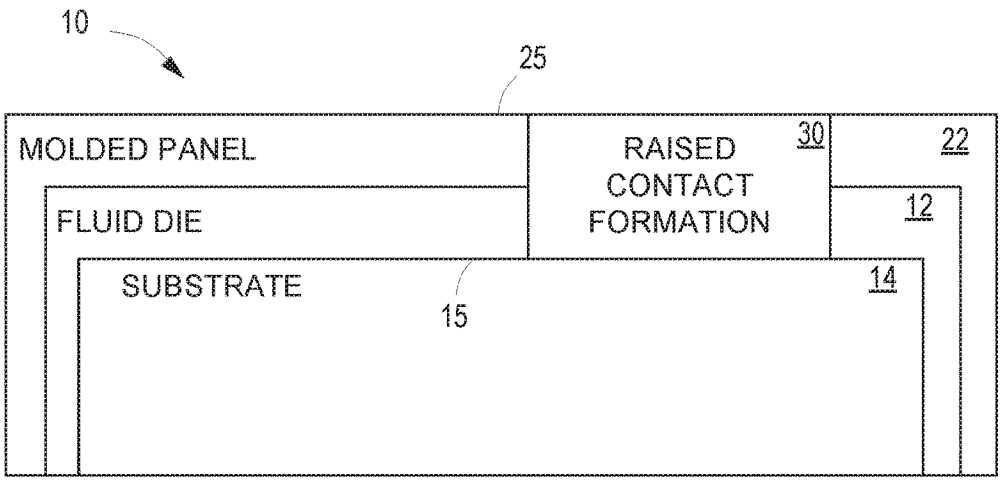
FIG. 1 is a block diagram of some components of an example fluid device.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DESCRIPTION

Examples of fluid devices may include a fluid die to receive a fluid. In some examples of fluid devices, a fluid in the die may be moved or mixed. In some examples, fluid devices may include a fluid ejection devices to dispense or eject a fluid. Example fluid ejection devices, as described herein, may be implemented in printing devices, such as two-dimensional printers and/or three-dimensional printers (3D). As will be appreciated, some example fluid ejection devices may be printheads. In some examples, a fluid ejection device may be implemented into a printing device and may be utilized to print content onto a medium, such as paper, a layer of powder-based build material, reactive devices (such as lab-on-a-chip devices), etc. Example fluid ejection devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected.

Examples of fluid devices may comprise at least one fluid die comprising a substrate including a first surface. In examples of fluid ejection devices, the substrate may include an array of nozzles formed therethrough. Furthermore, example fluid devices may comprise a molded panel in which the at least one fluid die may be embedded therein. In examples, fluid devices may be coupled to electrical components. For example, a fluid device may be coupled to an electrical circuit to drive the mixing of a fluid or ejection of a fluid from the nozzles. However, forming electrical connections may take a certain amount of space on the substrate and the molded panel may interfere with forming the electrical connection. In examples, the size of an electrical contact pad may be selected to allow for sufficient space to form the electrical connection. Furthermore, a certain clearance around the electrical contact pad may be maintained to ensure the molded panel does not interfere with or block a conductive member (e.g., a wire) coupling to the electrical contact pad. However, there is a need for a smaller fluid die size.

To address these issues, in the examples described herein, a fluid device is described in which a smaller portion of the substrate of the fluid die may be used to form an electrical connection. In such an example, a first surface of the substrate of the fluid die may be disposed below a top surface of the molded panel. In examples, a raised contact formation or conductive bump may be disposed on the first surface of the substrate to form an electrical connection between the fluid device and another component. In such examples, the raised contact formation may extend at least up to top surface of molded panel to form an electrical connection with another component at a location above the top surface of the molded panel. In such examples, the surface area of a substrate to form an electrical connection may be reduced.

As used herein, a raised contact formation that extends at least up to a top surface of a molded panel may describe the height of the raised contact formation extending at least to a location in which a top surface of the molded panel is approximately planar with a top surface of the raised contact formation. Approximately planar may refer to a plane of top surface of the raised contact formation and a plane of the top surface of the molded panel being generally parallel, where, herein, "approximately" and "generally" may refer to the surfaces having angles of orientation therebetween within a range of 0° to 10°. In other examples, a raised contact formation that extends at least up to a top surface of a molded panel may describe a raised contact formation having a height less than the molded panel. In such an example, the distance between the top surface of the raised contact formation and the top surface of the molded panel may be within a range of a thickness of a conductive member (e.g., a wire) to be coupled to the raised contact formation. In examples, the thickness of the conductive member may be up to 25 micrometers or microns (25 μm).

Accordingly, as used herein, the fluid die embedded in the molded panel may describe the arrangement of the fluid die such that side surfaces of the fluid die and at least one of a top surface or a bottom surface of the fluid die may be at least partially enclosed by the molded panel. In addition, the at least one fluid die may be described as molded into the molded panel. In some examples the substrate of the fluid die may be formed with silicon or a silicon-based material. Various features, such as nozzles, may be formed by etching and/or other such microfabrication processes.

Nozzles may facilitate ejection/dispensation of fluid. Fluid ejection devices may comprise fluid ejection actuators disposed proximate to the nozzles to cause fluid to be ejected/dispensed from a nozzle orifice. Some examples of types of fluid ejectors implemented in fluid ejection devices include thermal ejectors, piezoelectric ejectors, and/or other such ejectors that may cause fluid to eject/be dispensed from a nozzle orifice.

In some examples, fluid dies may be referred to as slivers. Generally, a sliver may correspond to a die having: a thickness of approximately 650 μm or less; exterior dimensions of approximately 30 mm or less; and/or a length to width ratio of approximately 3 to 1 or larger. In some examples, a length to width ratio of a sliver may be approximately 10 to 1 or larger. In some examples, a length to width ratio of a sliver may be approximately 50 to 1 or larger. In some examples, a length to width ratio of a sliver may be approximately 100 to 1 or larger. In some examples, fluid dies may be a non-rectangular shape.

In some examples, the molded panel may comprise an epoxy mold compound, such as CEL400ZHF40WG from Hitachi Chemical, Inc., and/or other such materials. Accordingly, in some examples, the molded panel may be substantially uniform. In some examples, the molded panel may be formed of a single piece, such that the molded panel may comprise a mold material without joints or seams. In some examples, the molded panel may be monolithic.

Turning now to the figures, and particularly to FIG. 1, this figure provides block diagram of some components of an example fluid device 10. The example fluid device 10 comprises a fluid die 12 that includes a substrate 14, where the substrate 14 includes a first surface 15. The example device 10 comprises a molded panel 22 having a top surface 25. In examples, molded panel 22 surrounds sides of fluid die 12 such that first surface 15 of substrate 14 is below a top surface 25 of molded panel 22. In other words, first surface 15 of substrate 14 may lay in a different plane than top surface 25 of molded panel 22. Throughout the description, wherever spatial orientations are described, it will be understood that the spatial orientation is exemplary of a relationship between components and may be rotated or changed in any manner while maintaining the relative relationship between components without altering the scope of the description. For examples, where a first component is described as being a top surface it may be understood that the component may be the bottom surface without altering the understanding of the first component relative to a second component. In examples, a raised contact formation 30 extends from first surface 15 of substrate 14 towards and at least up to top surface 25 of molded panel 22. It will be understood that, in some examples, at least a portion of first surface 15 is embedded in molded panel 22.

Figure 2:
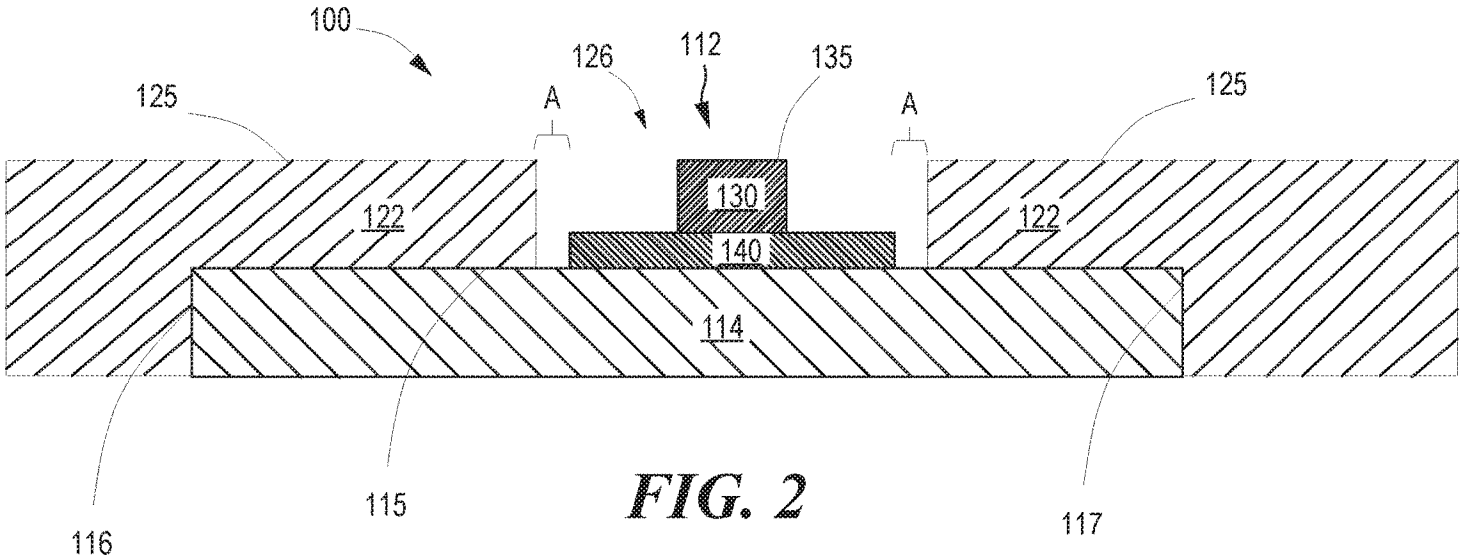
FIG. 2 is a side view of some components of an example fluid device.

FIG. 2 provides a side view of some components of an example fluid device 100. As shown in this example, the fluid device 100 comprises a fluid die 112 that includes a substrate 114. The substrate 114 includes a first surface 115. In examples, the substrate may include an array of nozzles formed therethrough (not shown). In examples, substrate 114 may be embedded in a molded panel 122. As shown, a second side 116 of substrate 114 and a third side 117 of substrate 114 may be surrounded by molded panel 122. In such examples, a portion of first surface 115 may be surrounded by molded panel 115. In such an example, first surface 115 of substrate 114 may be disposed below top surface 125 of molded panel 122. In examples, a portion of first surface 115 of substrate 114 may be exposed such that molded panel 122 is not disposed thereon or thereabove.

In examples, a raised contact formation 130 or conductive bump may be disposed on first surface 115 of substrate 114. In examples, raised contact formation 130 may be comprised of any material to provide an electrical connection. For example, raised contact formation 130 may be comprised of one or more conductors or semiconductors, such as, at least one of gold, aluminum, copper, silver, etc. In examples, raised contact formation 130 may form an electrical connection with or electrically couple to a component. In examples, raised contact formation 130 may be connected to an electrical contact pad 140 or bonding pad disposed on substrate 114 to form an electrical contact therewith. Furthermore, raised contact formation 130 may be disposed to form an electrical connection with another component at a top surface thereof. For example, raised contact formation 130 may be connected to a conductive member at a top surface 135. In the following discussion and in the claims, the term "couple" or "couples" is intended to include suitable indirect and/or direct connections. Thus, if a first component is described as being coupled to a second component, that coupling may, for example, be: (1) through a direct electrical or mechanical connection, (2) through an indirect electrical or mechanical connection via other devices and connections, (3) through an optical electrical connection, (4) through a wireless electrical connection, and/or (5) another suitable coupling. In contrast, the term "connect," "connects," or "connected" is intended to include direct mechanical and/or electrical connections.

In examples, raised contact formation 130 may be disposed to extend at least up to top surface 125 of molded panel 122. In some examples, top surface 125 of molded panel 122 may define a hole 126 through which at least a portion of first substrate 115 may be exposed. In such an example, raised contact formation 130 may be disposed to extend from electrical contact pad 140 through at least a portion of hole 126. In examples, raised contact formation 130 may be electrically connected to a conductive member at top surface 135. In other words, in examples described herein, raised contact formation 130 may be electrically connected to the conductive member at a location above top surface 125 of molded panel 122. In one example, top surface 135 of raised contact formation 130 may be disposed above top surface 125 of molded panel 122. In another example, top surface 135 of raised contact formation 130 may be disposed to be approximately planar with top surface 125 of molded panel 122. In some examples, more than one raised contact formation 130 may be disposed on substrate 114.

In examples, the conductive member may be any member to provide an electrical connection between components. For example, the conductive member may be a wire. In some examples, the conductive member may be connected to raised contact formation 130 at a location approximately planar with top surface 125 of molded panel 122. In other examples, the conductive member may be connected to raised contact formation 130 at a location above the plane of top surface 125 of molded panel 122. In examples, fluid die 112 may be embedded in molded panel 122 without molded panel 122 interfering with the electrical connection between raised contact formation 130 and the conductive member.

In examples, electrical contact pad 140 may be disposed on first surface 115 of substrate 114 to couple to raised contact formation 130. In examples, electrical contact pad 140 may be disposed over electrical traces of fluid die 112 to provide an electrical connection to such electrical traces. In examples, electrical contact pad 140 may be comprised of any material to provide an electrical connection. For example, electrical contact pad 140 may be comprised of one or more conductors or semiconductors, such as at least one of gold, aluminum, copper, silver, etc. In examples, a clearance A around the contact pad 140 to form an electrical contact may be reduced with the use of raised contact formation 130 to form the electrical coupling to the conductive member. In examples, the clearance A may be in a range from 10 μm to 50 μm. Although shown with a uniform clearance around electrical contact pad 140, the examples described herein may include non-uniform clearance around the electrical contact pad 140 with a minimum clearance being in the range described.

In examples, electrical contact pad 140 may have a cross-sectional of any shape in a plane parallel to first surface 115 of substrate 114 to provide an electrical connection. For example, electrical contact pad 140 may have a square or rectangular cross-section in a plane parallel to first surface 115 of substrate 114. In yet another example, contact pad 140 may have a circular cross-section in a plane parallel to first surface 115 of substrate 114. In examples, electrical contact pad 140 may have a width less than 100 micrometers. As used herein, the term width refers to the shortest of any dimensions which may describe the cross-section of electrical contact pad 140 in a plane parallel to first surface 115 of substrate 114. For example, when electrical contact pad 140 has a substantially square shape, the width may refer to any side of electrical contact pad 140 because all four sides may be substantially equal sized. In contrast, in an example where electrical contact pad 140 has a rectangular cross-section in a plane parallel to first surface 115 of substrate 114, the width may refer to the shortest side of electrical contact pad 140. As shown, raised contact formation 130 may electrically couple electrical contact pad or bonding pad 140 to the conductive member.

Figure 3A:
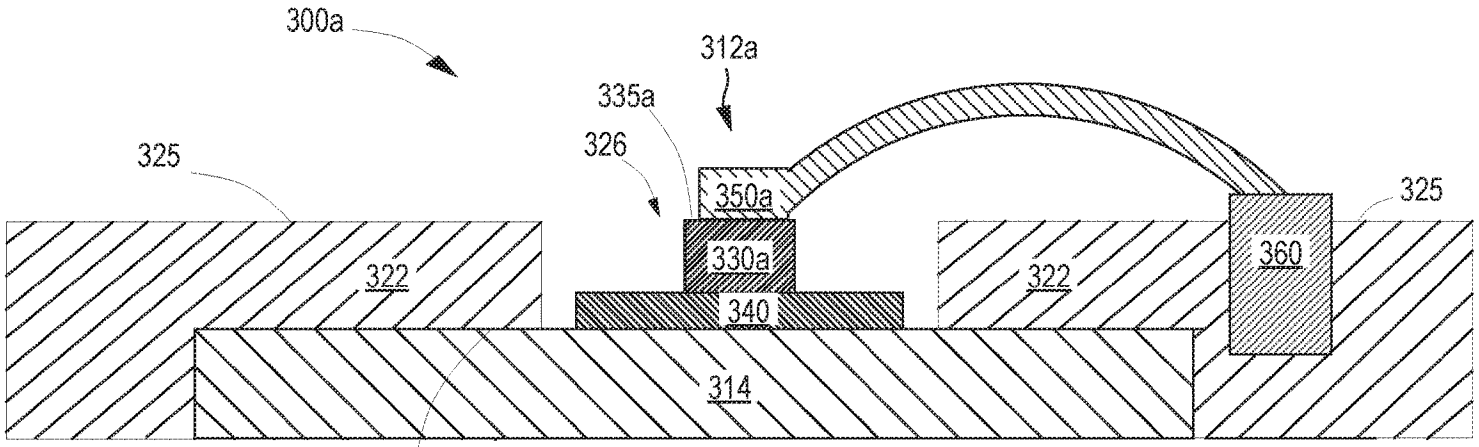
FIGS. 3A and 3B are side views of some components of an example fluid device.

Turning now to FIG. 3A, this figure illustrates a diagram of an example of a fluid device 300*a* including a fluid die 312*a*. The fluid device 300*a* may include all features discussed with reference to the examples of FIGS. 1-2. In examples, device 300*a* includes a substrate 314 on which an electrical contact pad 340 and a raised contact formation 330*a* are disposed. In examples, substrate 314 may be embedded in a molded panel 322 having a top surface 325. In this example, device 300*a* further includes a conductive member 350*a* having a first end and a second end. In examples, conductive member 350*a* may be electrically coupled to fluid die 312*a* via raised contact formation 330*a* at the first end. In examples, the first end of conductive member 350*a* may be connected to raised contact formation 330*a* at a location at least above the plane of top surface 325 of molded panel 322. In the example of FIG. 3A, a top surface 335*a* of raised contact formation 330*a* may be disposed to be approximately planar with top surface 325 of molded panel 322. In such an example, conductive member 350*a* may not extend into hole 326 to connect to raised contact formation 330*a*. In examples, conductive member 350*a* may be coupled to a circuit assembly 360 at a second end thereof.

In the example of FIG. 3A, fluid die 312*a* is supported by, or embedded in, molded panel 322. The molded panel 322 embeds or supports circuit assembly 360. In some examples, circuit assembly 360 may comprise an application specific integrated circuit (ASIC) or other such control circuitry that may be drive circuitry for fluid die 312*a*. In other examples, circuit assembly 360 may be a circuit interposer to facilitate electrical interface routing between fluid die 312*a* and an externally connected controller. In examples, circuit assembly 360 may protrude from molded panel 322. In other examples, a top surface of circuit assembly 360 may be approximately planar with top surface 325 of molded panel 322 (shown in FIG. 3B). In yet another example, the top surface of circuit assembly 360 may be disposed below top surface 325 of molded panel 322 (not shown).

Figure 3B:
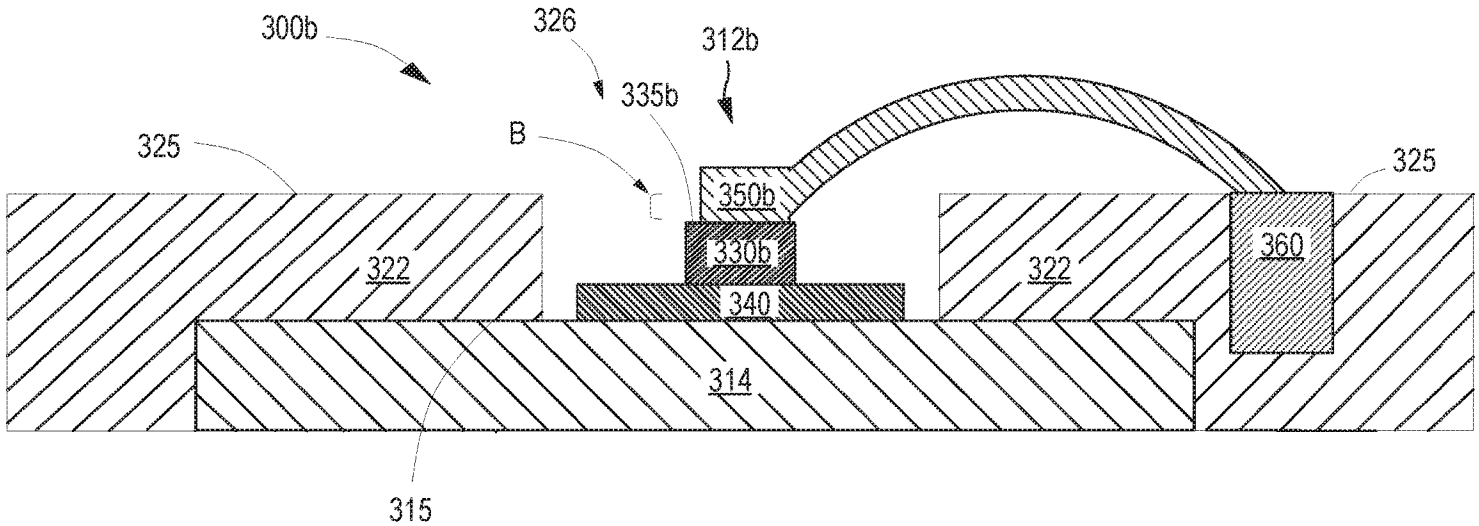

Turning now to FIG. 3B, this figure illustrates a diagram of an example of a fluid device 300*b* including a fluid ejection die 312*b*. The fluid device 300*b* may include all features discussed with reference to the examples of FIGS. 1-3A. In particular, any identically numbered features of FIGS. 3A and 3B may be substantially similar to each other. In examples, device 300*b* includes a substrate 314 on which an electrical contact pad 340 and a raised contact formation 330*b* are disposed. In examples, substrate 314 may be embedded in a molded panel 322 having a top surface 325.

In examples, device 300*b* further includes a conductive member 350*b* having a first end and a second end. In examples, conductive member 350*b* may be electrically coupled to fluid die 312*b* via raised contact formation 330*b* at the first end. In examples, the first end of conductive member 350*b* may be connected to raised contact formation 330*b* at a location at least above the plane of top surface 325 of molded panel 322. In the example of FIG. 3B, a top surface 335*b* of raised contact formation 330*b* may be disposed below a plane of top surface 325 of molded panel 322 by a distance B. In such an example, conductive member 350*b* may extend into hole 326 to connect to raised contact formation 330*b*. In examples, distance B may be chosen so that conductive member 350*b* extends into hole 326 to connect to raised contact formation 330*b* without contacting molded panel 322. In examples, conductive member 350*b* may be coupled to a circuit assembly 360 at a second end thereof. In the example of FIG. 3B, a top surface of circuit assembly 360 may be approximately planar with top surface 325 of molded panel 322.

Figure 4:
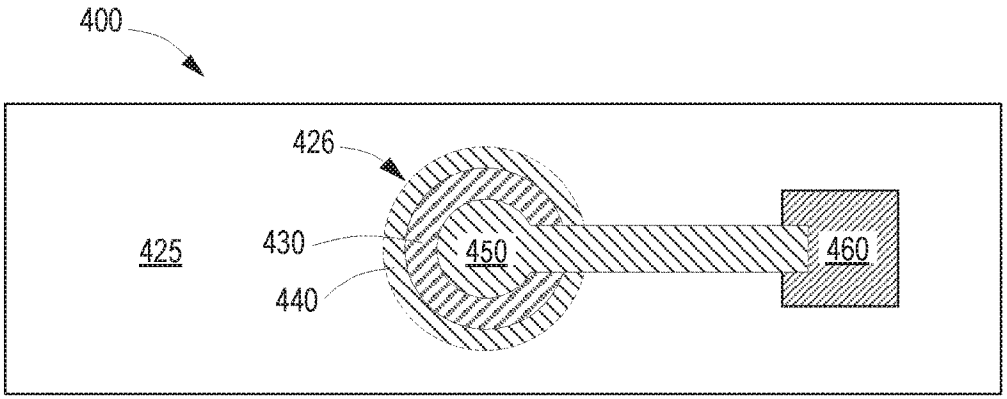
FIG. 4 is top view of some components of an example fluid device.

FIG. 4 provides a top view of some components of an example fluid device 400. Fluid device 400 may include all features discussed with reference to the examples of FIGS. 1-3B. In this example, fluid device 400 includes a raised contact formation 430 disposed on an electrical contact pad 440 surrounded by a molded panel with top surface 425 defining a hole 426 illustrated in dashed lines. In this example, the raised contact formation 430 may be connected to a first end of a conductive member 450 at a location above the top surface 425. Furthermore, conductive member 450 may be coupled to a circuit assembly 460 at a second end. It will be appreciated that the view of FIG. 4 provides a cross-sectional shape of raised contact formation 430 and hole 426 in a plane parallel to top surface 425. Although shown as having a circular cross-section, raised contact formation 430 and hole 426 may have any cross sectional shape.

Figure 5:
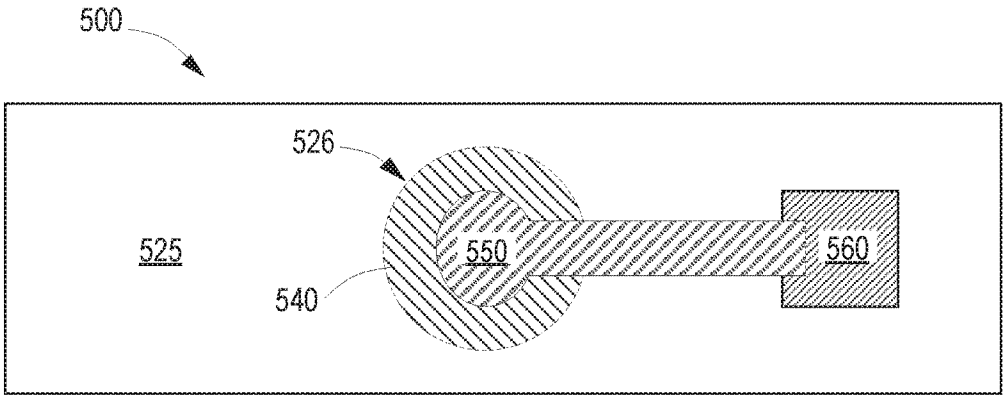
FIG. 5 is a top view of some components of an example fluid device.

FIG. 5 provides a top view of some components of an example fluid device 500. Fluid device 500 may include all features discussed with reference to the examples of FIGS. 1-4. In this example, the fluid device 500 includes a raised contact formation (not visible) disposed on an electrical contact pad 540 surrounded by a molded panel with top surface 525 defining a hole 526 illustrated in dashed lines. In this example, the raised contact formation may be connected to a first end of a conductive member 550 at a location above the top surface 525. Furthermore, conductive member 550 may be coupled to a circuit assembly 560 at a second end. It may be appreciated that conductive member 550 may be connected to the raised contact formation in such a manner that a bonding site between the raised contact formation and conductive member 550 has at least a substantially similar cross-sectional size as the cross-sectional size of the raised contact formation so that the raised contact formation is obscured from the top view.

Figure 6:
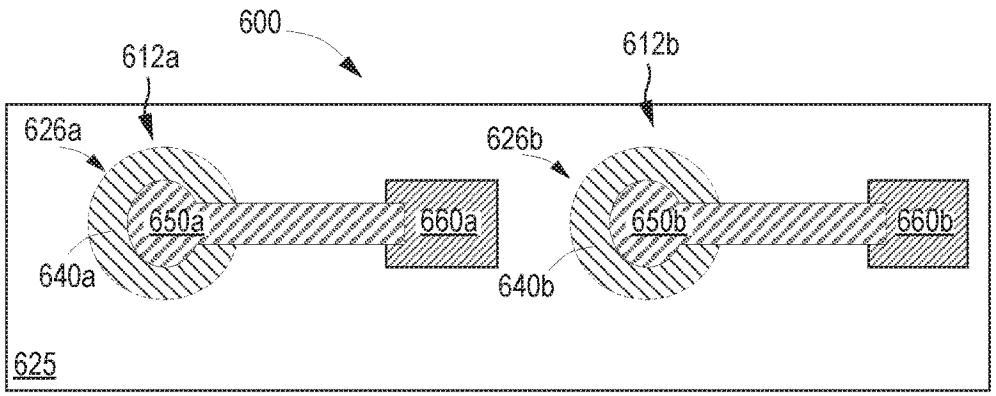
FIG. 6 is a top view of some components of an example fluid device.

FIG. 6 provides a top view of some components of an example fluid device 600. Fluid device 600 may include all features discussed with reference to the examples of FIGS. 1-5. In this example, fluid device 600 includes a first fluid die 612*a* and a second fluid die 612*b* embedded in a molded panel with top surface 625. In examples, top surface 625 defines a first hole 626*a* and a second hole 626*b* illustrated in dashed lines. In this example, fluid die 612*a* and fluid die 612*b* are arranged generally end-to-end along a length of the molded panel. As shown, fluid die 612*a* is coupled to a circuit assembly 660*a* via a conductive member 650*a* and fluid die 612*b* is coupled to a circuit assembly 660*b* via a conductive member 650*b*. Although not visible, fluid die 612*a* includes a raised contact formation disposed on an electrical contact pad 640*a* to electrically couple conductive member 650*a* with electrical contact pad 640*a*. In the examples, the raised contact formation of fluid die 612*a* may be connected to conductive member 650*a* at a location above the plane of top surface 625. Similarly, although not visible, fluid die 612*b* includes a raised contact formation disposed on an electrical contact pad 640*b* to electrically couple conductive member 650*b* with electrical contact pad 640*b*. In the examples, the raised contact formation of fluid die 612*b* may be connected to conductive member 650*b* at a location above the plane of top surface 625. It may be appreciated that conductive member 650*a* and conductive member 650*b* may be connected to respective raised contact formations in such a manner to obscure the respective raised contact formations from the top view.

Figure 7:
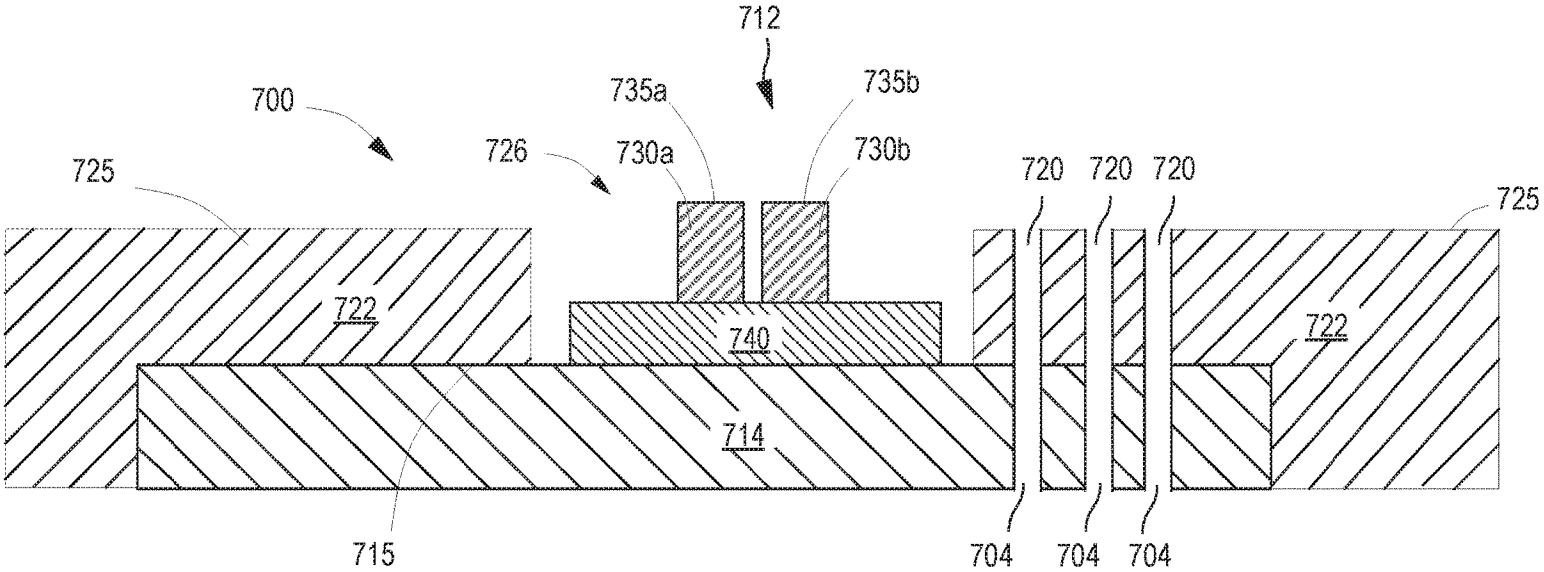
FIG. 7 is a side view of some components of an example fluid device.

Turning now to FIG. 7, this figure illustrates a diagram of an example of a fluid device 700 including a fluid ejection die 712. Fluid device 700 may include all features discussed with reference to the examples of FIGS. 1-6. In examples, the device 700 includes a substrate 714 on which an electrical contact pad 740 is disposed. The substrate 714 may include an array of nozzles 704 formed therethrough. Furthermore, a molded panel 722 may have a fluid channel 720 formed therethrough in fluid communication with the array of nozzles. In the example of FIG. 7, a first raised contact formation 730*a* and a second raised contact formation 730*b* are disposed on an electrical contact pad 740. As shown, first raised contact formation 730*a* and second raised contact formation 730*b* extend through a hole 726 to a location above a top surface 725 of the molded panel 722. As such, a first surface 735*a* of first raised contact formation 730*a* is located above the plane of top surface 725 of molded panel 722. Similarly, a first surface 735*b* of second raised contact formation 730*b* is located above the plane of top surface 725 of molded panel 722. In other examples, first raised contact formation 730*a* and second raised contact formation 730*b* may extend at least up to the plane of top surface 725 of molded panel 722.

Figure 8:
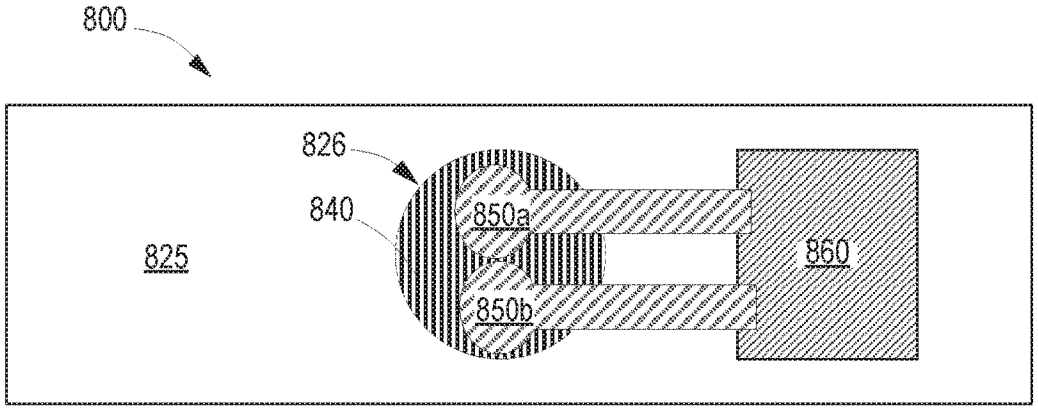
FIG. 8 is top view of some components of an example fluid device.

In examples, each of first raised contact formation 730*a* and second raised contact formation 730*b* may be coupled to a circuit assembly (not shown). In such an example, a single conductive member may be connected to both first raised contact formation 730*a* and second raised contact formation 730*b* in a manner similar to that shown in FIG. 5. In other examples, a separate conductive member may couple each of first raised contact formation 730*a* and second raised contact formation 730*b* to the circuit assembly (as shown in FIG. 8). In examples, each of first raised contact formation 730*a* and second raised contact formation 730*b* may be coupled to a separate circuit assembly (as shown in FIG. 9).

FIG. 8 provides a top view of some components of an example fluid device 800. Fluid device 800 may include all features discussed with reference to the examples of FIGS. 1-7. In this example, fluid device 800 includes an electrical contact pad 840 electrically coupled to a circuit assembly 860. In the example of FIG. 8, a plurality of raised contact formations (not visible) extend from electrical contact pad 840 to each connect to a conductive member 850*a* and a conductive member 850*b*. In this example, the raised contact formations may be connected to a first end of a conductive member 850*a* and a first end of conductive member 850*b*, respectively, at a location above top surface 825 of a molded panel. In examples, each of conductive member 850*a* and conductive member 850*b* may be coupled to circuit assembly 860.

Figure 9:
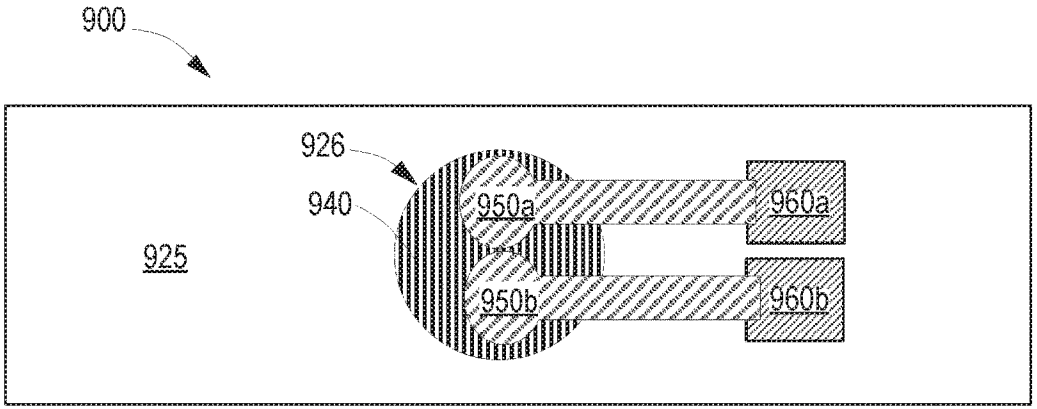
FIG. 9 is a top view of some components of an example fluid device.

FIG. 9 provides a top view of some components of an example fluid device 900. Fluid device 900 may include all features discussed with reference to the examples of FIGS. 1-8. In this example, fluid device 900 includes an electrical contact pad 940 electrically coupled to a circuit assembly 960*a* and a circuit assembly 960*b*. In the example of FIG. 9, at least two raised contact formations (not visible) extend from electrical contact pad 940 to each, respectively, connect to a conductive member 950*a* and a conductive member 950*b*. In this example, the raised contact formations may be connected to a first end of a conductive member 950*a* and a first end of conductive member 950*b*, respectively, at a location above a top surface 925 of a molded panel. In examples, conductive member 950*a* may be coupled to circuit assembly 960*a* and conductive member 950*b* may be coupled to circuit assembly 960*b*.

Figure 10:
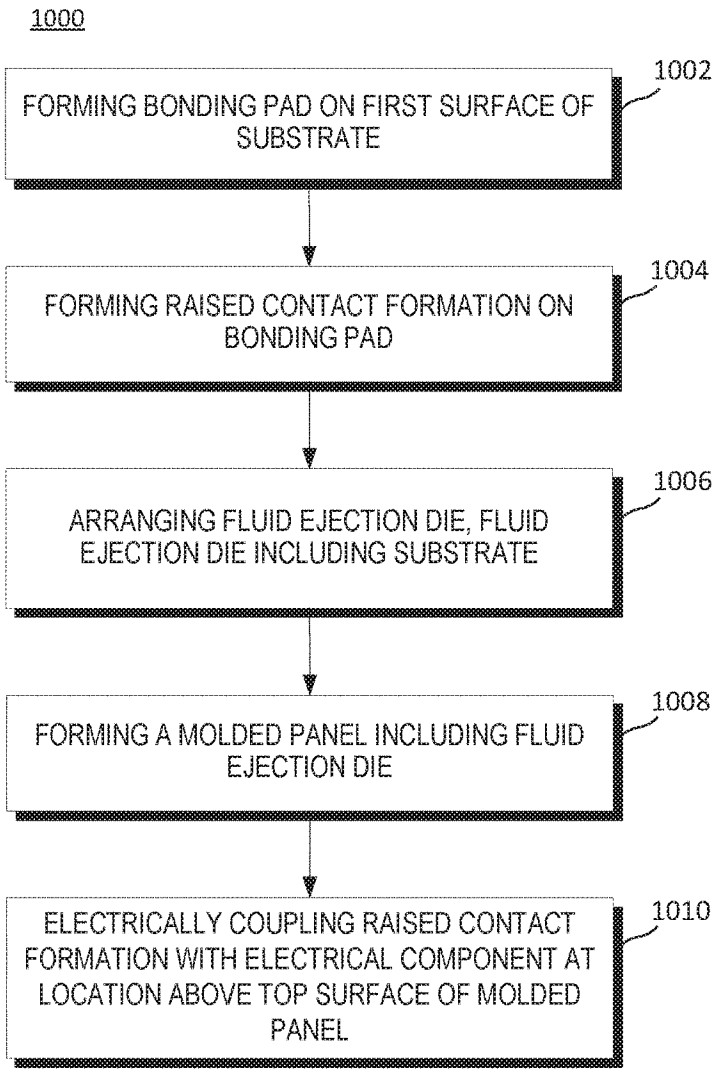
FIG. 10 is a flowchart of an example process.

FIG. 10 provides a flowchart that illustrate operations of example processes for forming example fluid devices as described herein.

Turning to FIG. 10, this figure provides a flowchart 1000 that illustrates a sequence of operations corresponding to a process to form example fluid devices. As shown in FIG. 10, with a conductive material, a bonding pad may be formed on a first surface of a substrate (block 1002). In examples, the bonding pad may be comprised of an electrically conductive material. In examples, electrically conductive materials may include at least one of aluminum, gold, silver, and copper. In examples, the bonding pad may have a width less than 100 micrometers. A raised contact formation or conductive bump may be formed on the bonding pad (block 1004). In examples, the raised contact formation may be comprised of an electrically conductive material. In examples, electrically conductive materials may include at least one of aluminum, gold, silver, and copper. In some examples, more than one raised contact formation may be formed. A fluid die may be arranged (block 1006), where the fluid ejection die may include the substrate. A molded panel may be formed that includes the fluid ejection dies (block 1008). In some examples, a molded panel may formed by compression molding, transfer molding, or other such exposed die molding processes. In examples, the molded panel may surround the first surface of the substrate such that at least a portion of the first surface is exposed and below a top surface of the molded panel. In examples, the raised contact formation may extend at least up to the top surface of the molded panel. The raised contact formation may be electrically coupled to an electrical component at a location above the top surface of the molded panel (block 1010).

Accordingly, examples provided herein may implement a fluid device comprising at least one fluid ejection die embedded in a molded panel. As discussed, the fluid die may comprise a substrate having a first surface including a bonding pad and a raised contact formation extending from the bonding pad to at least the top surface of the molded panel. As will be appreciated, embedding of fluid dies in a molded panel and forming an electrical connection with an electrical component at a location above the top surface of the molded panel may facilitate use of a smaller electrical contact pad or bonding pad. Furthermore, formation of electrical contacts above the top surface of the molded panel, may facilitate use of a smaller clearance between the bonding pad and the molded panel without interfering with the electrical coupling of the device with electrical components.

While various examples are described herein, elements and/or combinations of elements may be combined and/or removed for various examples contemplated hereby. For example, the example operations provided herein in the flowchart of FIG. 10 may be performed sequentially, concurrently, or in a different order. Moreover, some example operations of the flowchart may be added to other flowcharts, and/or some example operations may be removed from flowchart. Furthermore, in some examples, various components of the example devices of FIGS. 1-9 may be removed, and/or other components may be added.

The preceding description has been presented to illustrate and describe examples of the principles described. This description is not intended to be exhaustive or to limit these principles to any precise form disclosed. Many modifications and variations are possible in light of the description. Therefore, the foregoing examples provided in the figures and described herein should not be construed as limiting of the scope of the disclosure, which is defined in the Claims.

The invention claimed is:

1. A fluid device comprising:

a fluid die including a substrate having a first surface;

a molded panel on the fluid die, the molded panel surrounding a top surface of the fluid die such that at least a portion of the top surface of the fluid die is exposed and below a top surface of the molded panel; and a raised contact formation disposed on the first surface of the substrate such that the raised contact formation extends at least up to the top surface of the molded panel.

2. The fluid device of claim 1, wherein the molded panel extends over the top surface of the fluid die such that the top surface of the molded panel defines a hole through which the raised contact formation extends.

3. The fluid device of claim 1, further comprising:

a conductive member to connect to the raised contact formation at a location above the top surface of the molded panel.

4. The fluid device of claim 1, wherein the raised contact formation is comprised of at least one of gold, copper, silver, and aluminum.

5. The fluid device of claim 1, further comprising:

an electrical contact pad disposed on the first surface of the substrate to couple to the raised contact formation.

6. The fluid device of claim 5, wherein the electrical contact pad is comprised of at least one of aluminum, gold, silver, and copper.

7. The fluid device of claim 5, wherein the electrical contact pad has a width less than 100 micrometers (100 μm).

8. A fluid ejection device comprising:

a fluid ejection die comprising electrical traces on a substrate, the substrate including an array of nozzles extending therethrough;

a molded panel in which the fluid ejection die is embedded, the molded panel surrounding sides of the fluid ejection die such that a top surface of the fluid ejection die is disposed below a plane of the top surface of the molded panel, the molded panel having a fluid channel formed therethrough in fluid communication with the array of nozzles;

a conductive bump disposed on the top surface of the fluid ejection die to extend at least to the top surface of the molded panel; and a conductive member having a first end and a second end, the conductive member electrically connected to the fluid ejection die via the conductive bump at the first end at a location above the top surface of the molded panel, the conductive member electrically coupled to a circuit assembly at the second end.

9. The fluid ejection device of claim 8, wherein the bump is comprised of at least one of gold, copper, silver, aluminum.

10. The fluid ejection device of claim 8, further comprising:

an electrical contact pad disposed over the electrical traces of the fluid die, to connect to the conductive bump.

11. The fluid ejection device of claim 10, wherein the electrical contact pad is comprised of at least one of aluminum, gold, copper, and silver.

12. The fluid ejection device of claim 10, wherein the electrical contact pad has a width less than 100 micrometers (100 μm).

13. A process comprising:

forming a bonding pad on a top surface of a fluid ejection die, the bonding pad comprised of an electrically conductive material;

forming a raised contact formation on the bonding pad, the raised contact formation comprised of the electrically conductive material;

forming a molded panel on the fluid ejection die, the molded panel to surround the top surface of the fluid ejection die such that at least a portion of the top surface of the fluid ejection die is exposed and below a top surface of the molded panel; and electrically coupling the raised contact formation with an electrical component at a location above the top surface of the molded panel.

14. The process of claim 13, wherein the bonding pad has a width less than 100 micrometers (100 μm).

15. The process of claim 13, wherein the electrically conductive material may be comprised of at least one of aluminum, copper, gold, and silver.

* * * * *